US012312774B2

(12) United States Patent
Okuwaki et al.

(10) Patent No.: US 12,312,774 B2
(45) Date of Patent: May 27, 2025

(54) EXCAVATION INFORMATION PROCESSING DEVICE, WORK MACHINE, EXCAVATION SUPPORT DEVICE, AND EXCAVATION INFORMATION PROCESSING METHOD

(71) Applicant: KOMATSU LTD., Tokyo (JP)

(72) Inventors: Ryuta Okuwaki, Tokyo (JP); Kazuhiro Hatake, Tokyo (JP)

(73) Assignee: KOMATSU LTD., Tokyo (JP)

( * ) Notice: Subject to any disclaimer, the term of this patent is extended or adjusted under 35 U.S.C. 154(b) by 177 days.

(21) Appl. No.: 18/004,196

(22) PCT Filed: Jul. 27, 2021

(86) PCT No.: PCT/JP2021/027627

§ 371 (c)(1),
(2) Date: Jan. 4, 2023

(87) PCT Pub. No.: WO2022/030289

PCT Pub. Date: Feb. 10, 2022

(65) Prior Publication Data

US 2023/0243127 A1 Aug. 3, 2023

(30) Foreign Application Priority Data

Aug. 7, 2020 (JP) ..... 2020-134559

(51) Int. Cl.
*E02F 9/26* (2006.01)
*E02F 3/32* (2006.01)

(52) U.S. Cl.
CPC ..... *E02F 9/26* (2013.01); *E02F 3/32* (2013.01); *E02F 9/261* (2013.01)

(58) Field of Classification Search
CPC ..... E02F 9/26; E02F 3/32; E02F 9/261
USPC ..... 701/34.2
See application file for complete search history.

(56) References Cited

U.S. PATENT DOCUMENTS 8,942,895 B2 * 1/2015 Nomura ..... E02F 9/26 701/50
11,959,254 B2 * 4/2024 Sano ..... E02F 9/2235
2013/0158787 A1 * 6/2013 Nomura ..... E02F 9/26 701/34.4

(Continued)

FOREIGN PATENT DOCUMENTS

CN 103080437 A 5/2013
EP 3 617 410 A1 3/2020

(Continued)

*Primary Examiner* — Yazan A Soofi
*Assistant Examiner* — Ahmed Alkirsh
(74) *Attorney, Agent, or Firm* — Global IP Counselors, LLP

(57) ABSTRACT

An excavation information processing device includes an acquisition unit configured to acquire target object position information indicating an excavation target object by position information of a plurality of points, and an excavation earth amount estimation unit configured to sequentially estimate and output an excavation earth amount acquired by a bucket when the bucket performs holding at that point in time based on bucket position and posture information indicating a position and a posture of the bucket and the target object position information.

7 Claims, 12 Drawing Sheets

(56) References Cited

U.S. PATENT DOCUMENTS

| | | | | |
|---|---|---|---|---|
| 2014/0167971 | A1* | 6/2014 | Stanley | E02F 9/2296 340/666 |
| 2016/0040398 | A1* | 2/2016 | Kitajima | E02F 3/435 701/50 |
| 2017/0028922 | A1 | 2/2017 | Matsuo et al. | |
| 2017/0191246 | A1* | 7/2017 | Friend | E02F 3/434 |
| 2020/0041331 | A1* | 2/2020 | Hoshino | E02F 9/2221 |
| 2020/0056346 | A1* | 2/2020 | Izumikawa | E02F 9/267 |
| 2020/0131740 | A1* | 4/2020 | Hashimoto | E02F 9/262 |
| 2020/0407949 | A1* | 12/2020 | Aizawa | E02F 9/2041 |

FOREIGN PATENT DOCUMENTS

| | | | |
|---|---|---|---|
| EP | 3 779 067 | A1 | 2/2021 |
| JP | 2019-39207 | A | 3/2019 |
| JP | 2019-39280 | A | 3/2019 |
| JP | 2020-20153 | A | 2/2020 |
| WO | 2015/162710 | A1 | 10/2015 |
| WO | 2018/199143 | A1 | 11/2018 |
| WO | 2019/189260 | A1 | 10/2019 |

* cited by examiner

EXCAVATION INFORMATION PROCESSING DEVICE, WORK MACHINE, EXCAVATION SUPPORT DEVICE, AND EXCAVATION INFORMATION PROCESSING METHOD

CROSS-REFERENCE TO RELATED APPLICATIONS

This application is a U.S. National stage application of International Application No. PCT/JP2021/027627, filed on Jul. 27, 2021. This U.S. National stage application claims priority under 35 U.S.C. § 119(a) to Japanese Patent Application No. 2020-134559, filed in Japan on Aug. 7, 2020, the entire contents of which are hereby incorporated herein by reference.

TECHNICAL FIELD

The present disclosure relates to an excavation information processing device, a work machine, an excavation support device, and an excavation information processing method.

BACKGROUND INFORMATION

In an excavation device described in WO 2015/162710 A1, a bucket, a ground surface, and an excavated object are recognized from an image captured by a stereo camera, and an excavation point is determined on the basis of a result of the recognition. The excavation point is a position at which the bucket is first brought into contact with the excavated object during an excavation operation, and in this excavation device, the excavation point is determined such that the excavation amount (excavation earth amount) is large, the ground is not scraped, and the excavated object does not fall. In this excavation device, excavation is performed by scooping up a bucket from the excavation point.

SUMMARY

In the excavation device described in WO 2015/162710 A1, an excavation object is excavated by scooping up a bucket from an excavation point determined so as to be large in excavation earth amount. In the excavation device described in WO 2015/162710 A1, for example, there is a problem in that it is difficult to adjust the excavation earth amount to a freely-selected value.

The present disclosure has been made in view of the above circumstances, and an object thereof is to provide an excavation information processing device, a work machine, an excavation support device, and an excavation information processing method that are capable of easily adjusting an excavation earth amount to a freely-selected value.

One aspect of the present disclosure is an excavation information processing device including: an acquisition unit configured to acquire target object position information indicating an excavation target object by position information of a plurality of points; and an excavation earth amount estimation unit configured to sequentially estimate and output an excavation earth amount acquired by a bucket when the bucket performs holding at that point in time, based on bucket position and posture information indicating a position and a posture of the bucket and the target object position information.

According to the excavation information processing device, the work machine, the excavation support device, and the excavation information processing method of the present disclosure, it is possible to easily adjust the excavation earth amount to a freely-selected value.

DETAILED DESCRIPTION OF EMBODIMENTS

Figure 1:
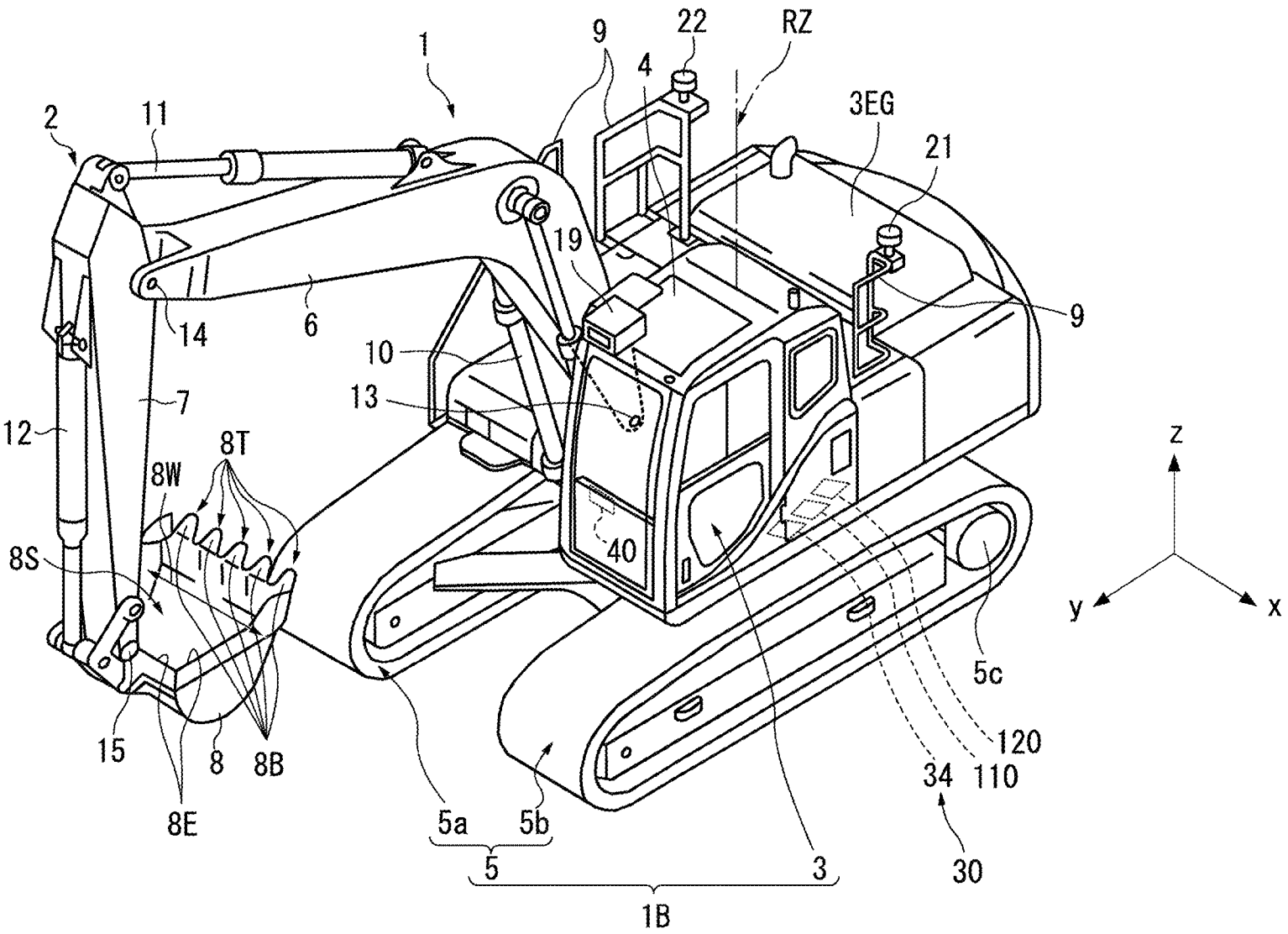
FIG. 1 is a perspective view illustrating a configuration example of a hydraulic excavator according to an embodiment of the present disclosure.

Hereinafter, embodiments of the present disclosure will be described with reference to the drawings. In the drawings, the same or corresponding components are denoted by the same reference numerals, and a description thereof will be omitted as appropriate.

Figure 2:
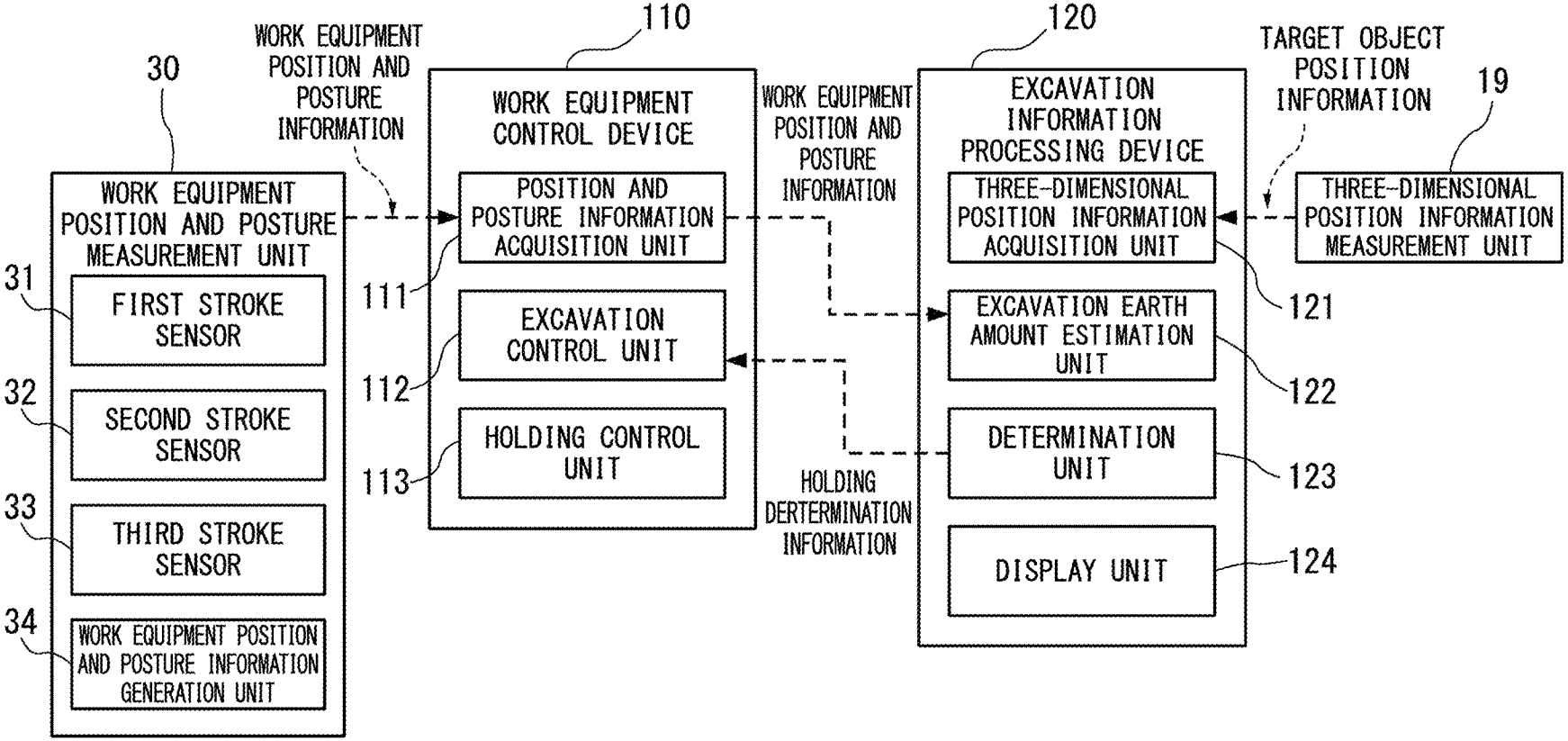
FIG. 2 is a block diagram illustrating a configuration example of a work equipment position and posture measurement unit 30, a work equipment control device 110, and an excavation information processing device 120 shown in FIG. 1.
Figure 3:
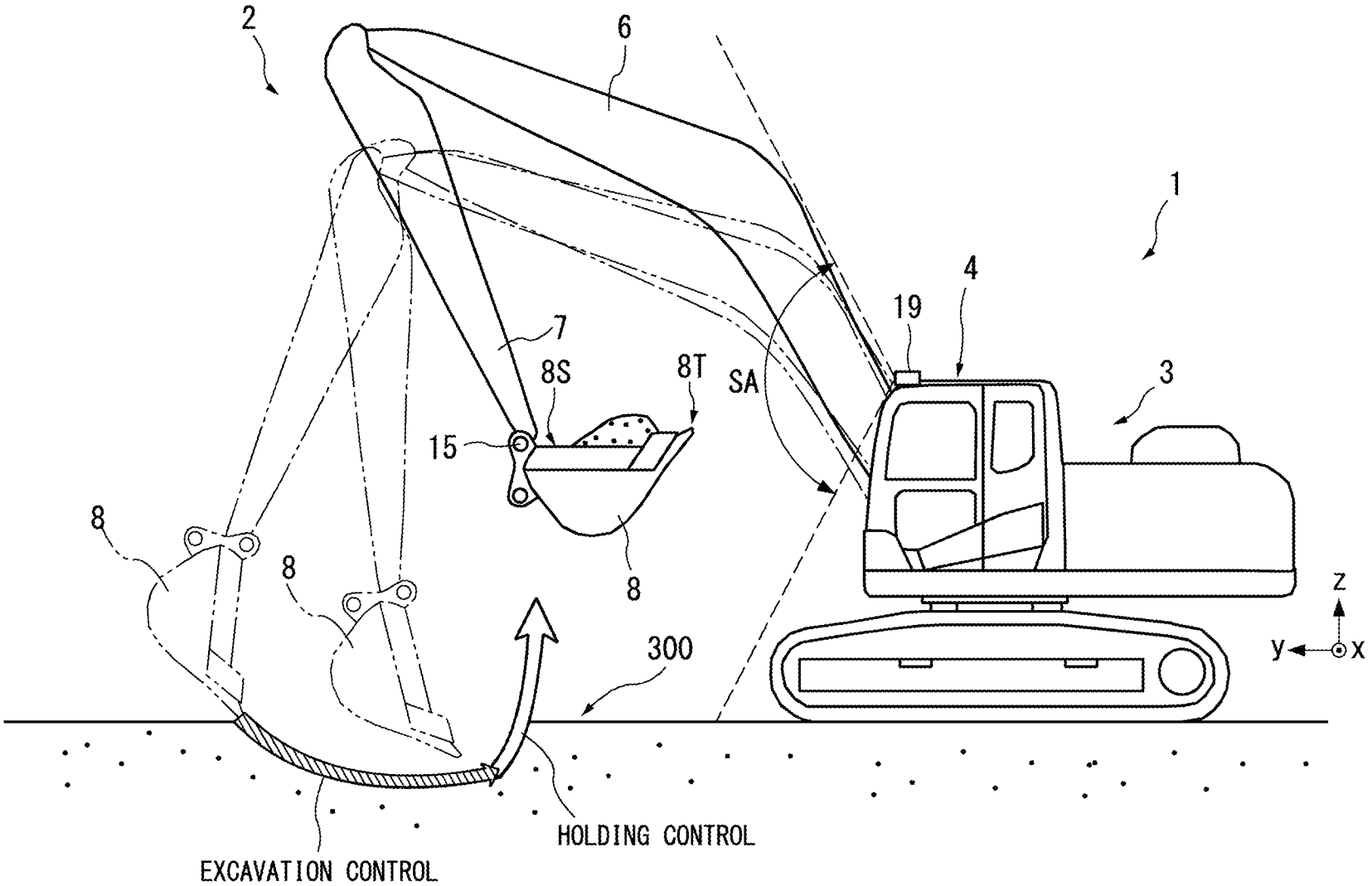
FIG. 3 is a side view illustrating a hydraulic excavator 1 shown in FIG. 1 in a simplified manner.

FIG. 1 is a perspective view illustrating a configuration example of a hydraulic excavator 1 as a work machine according to an embodiment of the present disclosure. FIG. 2 is a block diagram illustrating a configuration example of a work equipment position and posture measurement unit 30, a work equipment control device 110, and an excavation information processing device 120 shown in FIG. 1. FIG. 3 is a side view illustrating the hydraulic excavator 1 shown in FIG. 1 in a simplified manner.

The hydraulic excavator 1 shown in FIG. 1 includes a vehicle main body 1B as a main body portion and work equipment 2. The vehicle main body 1B has an upper swing body 3 that is a swing body and a travel device 5 as a travel body. The upper swing body 3 accommodates devices, such as an engine, which is a power generation device, and an oil pressure pump inside an engine room 3EG. In the present embodiment, the hydraulic excavator 1 can use, for example, an internal-combustion engine, such as a diesel engine, as an engine that is a power generation device. However, the power generation device is not limited to the internal-combustion engine. The power generation device of the hydraulic excavator 1 may be, for example, a so-called hybrid type device in which an internal-combustion engine, a generator motor, and a power storage device are combined. Further, the power generation device of the hydraulic excavator 1 may be a device or the like that does not have an internal-combustion engine and is a combination of a power storage device and a generator motor.

The upper swing body 3 has a cab 4. An operator of the hydraulic excavator 1 gets on the cab 4 and operates the hydraulic excavator 1. That is, in the cab 4, the operator of the hydraulic excavator 1 operates the work equipment 2, swings the upper swing body 3, and causes the hydraulic excavator 1 to travel using the travel device 5. The cab 4 is provided with a display device 40 for displaying various information, an operation device (not shown) for the work equipment 2 operated by the operator, an operation device (not shown) for the travel device 5, and the like. In the example shown in the FIG. 1, the cab 4 is located on a side of the upper swing body 3 opposite to a side on which the engine room 3EG is located. However, the positional relationship between the cab 4 and the engine room 3EG is not limited to this example. A handrail 9 is attached to an upper portion of the upper swing body 3.

The travel device 5 mounts the upper swing body 3 so as to be swingable about a swing axis RZ with respect to the travel device 5. The travel device 5 includes crawler tracks 5*a* and 5*b*. In the travel device 5, one or both of hydraulic motors 5*c* provided on the right and left sides are driven. The crawler tracks 5*a* and 5*b* of the travel device 5 rotate to cause the hydraulic excavator 1 to travel. The work equipment 2 is attached to a lateral side of the cab 4 of the upper swing body 3. The travel device 5 is provided with a sensor for measuring the swing angle of the upper swing body 3.

The hydraulic excavator 1 may be provided with tires instead of the crawler tracks 5*a* and 5*b*, and may include a travel device capable of traveling by transmitting a driving force of the engine to the tires via a transmission. As the hydraulic excavator 1 of such a form, there is, for example, a wheel type hydraulic excavator.

In the upper swing body 3, a side on which the work equipment 2 and the cab 4 are disposed is a front side, and a side on which the engine room 3EG is disposed is a rear side. The front-rear direction of the upper swing body 3 is a y direction. A left side when directing the front side is a left side of the upper swing body 3, and a right side when directing the front side is a right side of the upper swing body 3. The right-left direction of the upper swing body 3 is also referred to as a width direction or an x direction. In the hydraulic excavator 1 or the vehicle main body 1B, the travel device 5 side with respect to the upper swing body 3 is a lower side, and the upper swing body 3 side with respect to the travel device 5 is an upper side. The up-down direction of the upper swing body 3 is a z direction. In a case where the hydraulic excavator 1 is installed on a horizontal surface, the lower side is a vertical direction, that is, an acting direction side of gravity, and the upper side is a side opposite to the vertical direction. The xyz coordinate system is a coordinate system based on the hydraulic excavator 1 (upper swing body 3), and is referred to as a local coordinate system in the present embodiment. In addition, the arrows x, y, and z shown in FIG. 1 and other figures indicate the directions in the local coordinate system, but do not specify the position of the origin.

The work equipment 2 includes a boom 6, an arm 7, a bucket 8 serving as a work tool, a boom cylinder 10, an arm cylinder 11, and a bucket cylinder 12. A base end portion of the boom 6 is rotatably attached to a front portion of the upper swing body 3 via a boom pin 13. A base end portion of the arm 7 is rotatably attached to a tip end portion of the boom 6 via an arm pin 14. The bucket 8 is attached to a tip end portion of the arm 7 via a bucket pin 15. The bucket 8 rotates about the bucket pin 15. Teeth 8B are attached to the bucket 8 on a side opposite to the bucket pin 15. A teeth edge 8T is a tip of the teeth 8B. Further, in the present embodiment, a leveled surface by a bucket upper edge 8E is referred to as a bucket surface 8S. In addition, the bucket 8 may not have the teeth 8B. That is, the bucket may not have the teeth 8B as shown in FIG. 1, and the teeth edge may be formed in a straight shape by a steel plate.

Each of the boom cylinder 10, the arm cylinder 11, and the bucket cylinder 12 shown in FIG. 1 is a hydraulic cylinder that is driven by the pressure of hydraulic oil discharged from a hydraulic pump. The boom cylinder 10 drives the boom 6 to move up and down. The arm cylinder 11 drives the arm 7 to rotate around the arm pin 14. The bucket cylinder 12 drives the bucket 8 to rotate around the bucket pin 15.

Further, the work equipment 2 also includes the work equipment position and posture measurement unit 30. As shown in FIG. 2, the work equipment position and posture measurement unit 30 includes a first stroke sensor 31, a second stroke sensor 32, a third stroke sensor 33, and a work equipment position and posture information generation unit 34. The first stroke sensor 31 is provided in the boom cylinder 10, the second stroke sensor 32 is provided in the arm cylinder 11, and the third stroke sensor 33 is provided in the bucket cylinder 12. The first stroke sensor 31 detects a boom cylinder length, which is the length of the boom cylinder 10, and outputs the boom cylinder length to the work equipment position and posture information generation unit 34. The second stroke sensor 32 detects an arm cylinder length, which is the length of the arm cylinder 11, and outputs the arm cylinder length to the work equipment position and posture information generation unit 34. The third stroke sensor detects a bucket cylinder length, which is the length of the bucket cylinder 12, and outputs the bucket cylinder length to the work equipment position and posture information generation unit 34.

When the boom cylinder length, the arm cylinder length, and the bucket cylinder length are determined, a posture of the work equipment 2 is determined. In addition, the first stroke sensor 31, the second stroke sensor 32, and the third stroke sensor 33 may be angle detectors or the like.

The work equipment position and posture information generation unit 34 calculates an inclination angle of the boom 6 with respect to a direction (z-axis direction) orthogonal to a horizontal plane in the local coordinate system from the boom cylinder length detected by the first stroke sensor 31. The work equipment position and posture information generation unit 34 also calculates an inclination angle of the arm 7 with respect to the boom 6 from the arm cylinder length detected by the second stroke sensor 32. The work equipment position and posture information generation unit 34 also calculates an inclination angle of the bucket 8 with respect to the arm 7 from the bucket cylinder length detected by the third stroke sensor 33. In addition, the work equipment position and posture information generation unit 34 generates and outputs work equipment position and posture information indicating the posture and a position of the work equipment 2 in the local coordinate system based on the three-dimensional shape information (dimension information) of the work equipment 2 and each inclination angle of the boom 6, the arm 7, and the bucket 8. The work equipment position and posture information includes information indicating a position and angle (posture) of the bucket 8.

Antennas 21 and 22 are attached to an upper portion of the upper swing body 3. The antennas 21 and 22 are used to detect the current position of the hydraulic excavator 1. The antennas 21 and 22 are connected to, for example, the work equipment control device 110 (or a peripheral circuit thereof). The work equipment control device 110 (or the peripheral circuit thereof) receives radio waves from RTK-GNSS (Real Time Kinematic-Global Navigation Satellite Systems, GNSS refers to a global navigation satellite system) using the antennas 21 and 22, and detects the current position of the hydraulic excavator 1. Signals corresponding to the GNSS radio waves received by the antennas 21 and 22 are input to the work equipment control device 110, and the installation positions of the antennas 21 and 22 in a global coordinate system are calculated. An example of the global navigation satellite system includes a GPS (Global Positioning System), but the global navigation satellite system is not limited thereto.

As shown in FIG. 1, it is preferable that the antennas 21 and 22 be installed on the upper swing body 3 and at both end positions separated from each other in the right-left directions, that is, in the width direction of the hydraulic excavator 1. In the present embodiment, the antennas 21 and 22 are attached to the handrails 9 respectively attached to both sides of the upper swing body 3 in the width direction. The position at which the antennas 21 and 22 are attached to the upper swing body 3 is not limited to the handrail 9; however, it is preferable that the antennas 21 and 22 be installed at positions as distant as possible because a detection accuracy of the current position of the hydraulic excavator 1 is improved. In addition, it is preferable that the antennas 21 and 22 be installed at positions that do not interfere with a field of view of the operator as much as possible.

Figure 6:
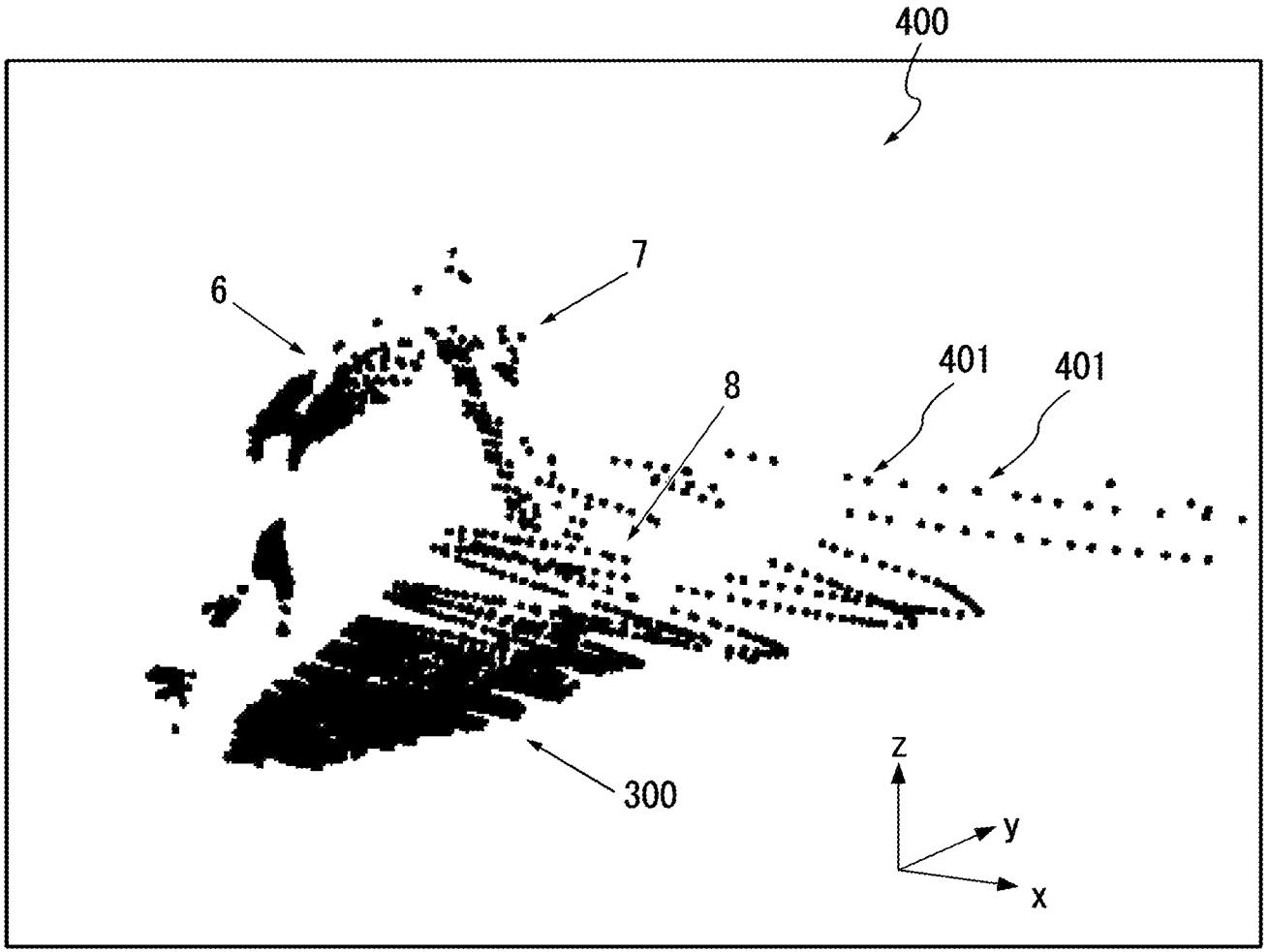
FIG. 6 is a schematic view illustrating an example of point cloud data 400 measured by a three-dimensional position information measurement unit 19 shown in FIG. 1.

Further, the hydraulic excavator 1 includes a three-dimensional position information measurement unit 19. The three-dimensional position information measurement unit 19 is installed, for example, above the cab 4, and as shown in FIG. 3, measures the three-dimensional position of an object (target object) existing in a measurement range SA including the bucket 8 and an excavation target object 300, such as earth or rocks, at a plurality of points (a plurality of measurement points), converts the three-dimensional position of each measurement point into point cloud data, and outputs the point cloud data as target object position information. Here, the three-dimensional position information measurement unit 19 outputs, as the target object position information, point cloud data in which the three-dimensional position of each measurement point is indicated by, for example, x, y, and z coordinates of the local coordinate system. In addition, in the present embodiment, the point cloud data and the target object position information have the same meaning. However, the target object position information is not limited to the point cloud data, and may be, for example, information indicating a three-dimensional model, such as a solid model. The point cloud data includes information representing a shape (topography) of the excavation target object 300 before and after the excavation, and information representing a shape of the excavation target object 300 inside and outside the bucket 8 during the excavation. The three-dimensional position information measurement unit 19 can be configured using, for example, a three-dimensional laser range finder, a three-dimensional laser scanner, a three-dimensional distance sensor, a stereo camera, or the like. The three-dimensional laser range finder or the like is also referred to as a light detection and ranging (LiDAR) or the like, irradiates laser light emitting in a pulsed manner while sequentially scanning the measurement directions with respect to multiple measurement directions (x, y, z directions) over a certain range, and measures a distance and direction based on, for example, a time up to the reflected scattered light being returned and the irradiation direction. In the present embodiment, the three-dimensional position information measurement unit 19 is configured using LiDAR. In this case, the three-dimensional position information measurement unit 19 sequentially stores and updates point cloud data indicating a measurement result of each measurement point (each reflection point) for each scanning cycle, and outputs the point cloud data as the target object position information. The target object position information is information in which the excavation target object 300 is indicated by position information of a plurality of points. The target object position information indicates, for example, each position of each measurement point by each coordinate information of the plurality of measurement points, and also indicates a shape of the plurality of measurement points by a line or a plane connecting each measurement point adjacent to each other. FIG. 6 illustrates an example of point cloud data 400 measured by the three-dimensional position information measurement unit 19 according to the present embodiment. The point cloud data 400 includes three-dimensional position information of a plurality of measurement points 401. Further, the point cloud data 400 includes three-dimensional position information of the plurality of measurement points 401 corresponding to the boom 6, the arm 7, the bucket 8, and the excavation target object 300. In addition, the point cloud data output by the three-dimensional position information measurement unit 19 is not limited to the point cloud data indicating the three-dimensional coordinate value of each measurement point, and may be point cloud data indicating a distance and direction to each measurement point. In addition, in a case where the three-dimensional position information measurement unit 19 is configured using a stereo camera, for example, a plurality of predetermined feature points subjected to image recognition can be set as the measurement points 401.

The hydraulic excavator 1 shown in FIG. 1 includes the work equipment control device 110 and the excavation information processing device (excavation support device) 120 shown in FIGS. 1 and 2. The work equipment control device 110 controls the boom cylinder 10, the arm cylinder 11, and the bucket cylinder 12 of the work equipment 2 to control, for example, the position and the posture of the bucket 8. In the present embodiment, the work equipment control device 110 manually controls the position and the posture of the bucket 8 in accordance with an instruction of an operator using a predetermined operation device, or automatically controls the position and the posture of the bucket 8 based on a position or trajectory set in advance. Further, in the present embodiment, the work equipment control device 110 has a function of automatically controlling excavation work. The automatic control of the excavation work can be configured by, for example, a combination of a plurality of controls as follows. That is, the automatic control of the excavation work can include, for example, movement control of the bucket 8 to an excavation start position, excavation control (FIG. 3) that is a control of an operation of excavating the excavation target object 300 with the bucket 8, holding control (FIG. 3) that is a control of an operation of holding the excavation target object 300 with the bucket 8, movement control of the bucket 8 to the dumping position (or loading position), and dumping control (loading control). The work equipment control device 110 of the present embodiment automatically performs, among the above controls, at least the excavation control, the holding control, and a switching control from the excavation control to the holding control.

The work equipment control device 110 illustrated in FIG. 2 can be configured using, for example, a computer such as a microcomputer or a field programmable gate array (FPGA), or a computer and a peripheral circuit or peripheral device thereof. The work equipment control device 110 includes at least a position and posture information acquisition unit 111, an excavation control unit 112, and a holding control unit 113 as a functional configuration configured by a combination of hardware such as a computer, a peripheral circuit, and a peripheral device and software such as a program executed by the computer.

The position and posture information acquisition unit 111 repeatedly acquires, for example, in a predetermined cycle, the work equipment position and posture information generated and output by the work equipment position and posture information generation unit 34 from the work equipment position and posture measurement unit 30. Further, the position and posture information acquisition unit 111 outputs the acquired work equipment position and posture information to the excavation information processing device 120.

The excavation control unit 112 controls the position and the posture of the bucket 8 on the basis of the work equipment position and posture information acquired by the position and posture information acquisition unit 111 so that, for example, the trajectory of the teeth edge 8T of the bucket 8 matches a target trajectory in the operation of excavating the excavation target object 300 with the bucket 8. The target trajectory in the excavating operation can be determined by the excavation control unit 112 or another control unit (not shown) based on, for example, the target value of the excavation earth amount, the target value of the excavation shape, the topography shape, and the like. Further, the excavation control unit 112 performs switching control from the excavation control to the holding control based on the holding determination information output by the excavation information processing device 120.

In response to an instruction from the excavation control unit 112, the holding control unit 113 controls the position and the posture of the bucket 8 so that, for example, the trajectory of the teeth edge 8T of the bucket 8 matches a target trajectory in the operation of holding the excavation target object 300 with the bucket 8. The target trajectory in the holding operation can be, for example, a trajectory in which the bucket surface 8S moves to a predetermined height in a posture orthogonal to the vertical direction so that the bucket 8 does not further excavate the excavation target object 300.

Further, the excavation information processing device 120 can be configured as a single device similarly to the work equipment control device 110, or can be configured integrally with the work equipment control device 110 or another control device of the hydraulic excavator 1 by using, for example, a computer such as a microcomputer or an FPGA, or a computer and a peripheral circuit or peripheral device thereof. The excavation information processing device 120 includes a three-dimensional position information acquisition unit (acquisition unit) 121, an excavation earth amount estimation unit 122, a determination unit 123, and a display unit 124 as a functional configuration configured by a combination of hardware, such as a computer, a peripheral circuit, and a peripheral device, and software, such as a program executed by the computer.

The three-dimensional position information acquisition unit 121 repeatedly acquires, for example, in a predetermined cycle, target object position information (point cloud data 400) indicating the excavation target object by position information of a plurality of points from the three-dimensional position information measurement unit 19, and outputs the target object position information to the excavation earth amount estimation unit 122.

The excavation earth amount estimation unit 122 sequentially estimates and outputs an excavation earth amount SVA acquired by the bucket 8 in a case where the bucket 8 performs holding at that point in time based on bucket position and posture information indicating the position and the posture of the bucket 8 input from the position and posture information acquisition unit 111 and the target object position information acquired by the three-dimensional position information acquisition unit 121. The excavation earth amount estimation unit 122 may output the result of estimation of the excavation earth amount SVA, for example, as a value of a volume of the excavation earth amount SVA, as a value of a weight of the excavation earth amount SVA, or as a value indicating the ratio of the volume or the weight of the excavation earth amount SVA with respect to a predetermined reference value. In addition, a conversion from the volume to the weight can be performed as follows, for example. That is, for example, the weight of the excavation earth amount after the first excavation work (in the scooped-up state) is calculated by the cylinder pressure and the work equipment posture, a relationship (specific gravity or the like) between the calculated weight and the estimated excavation earth amount is obtained, and the volume can be converted into the weight using said relationship.

Figure 7:
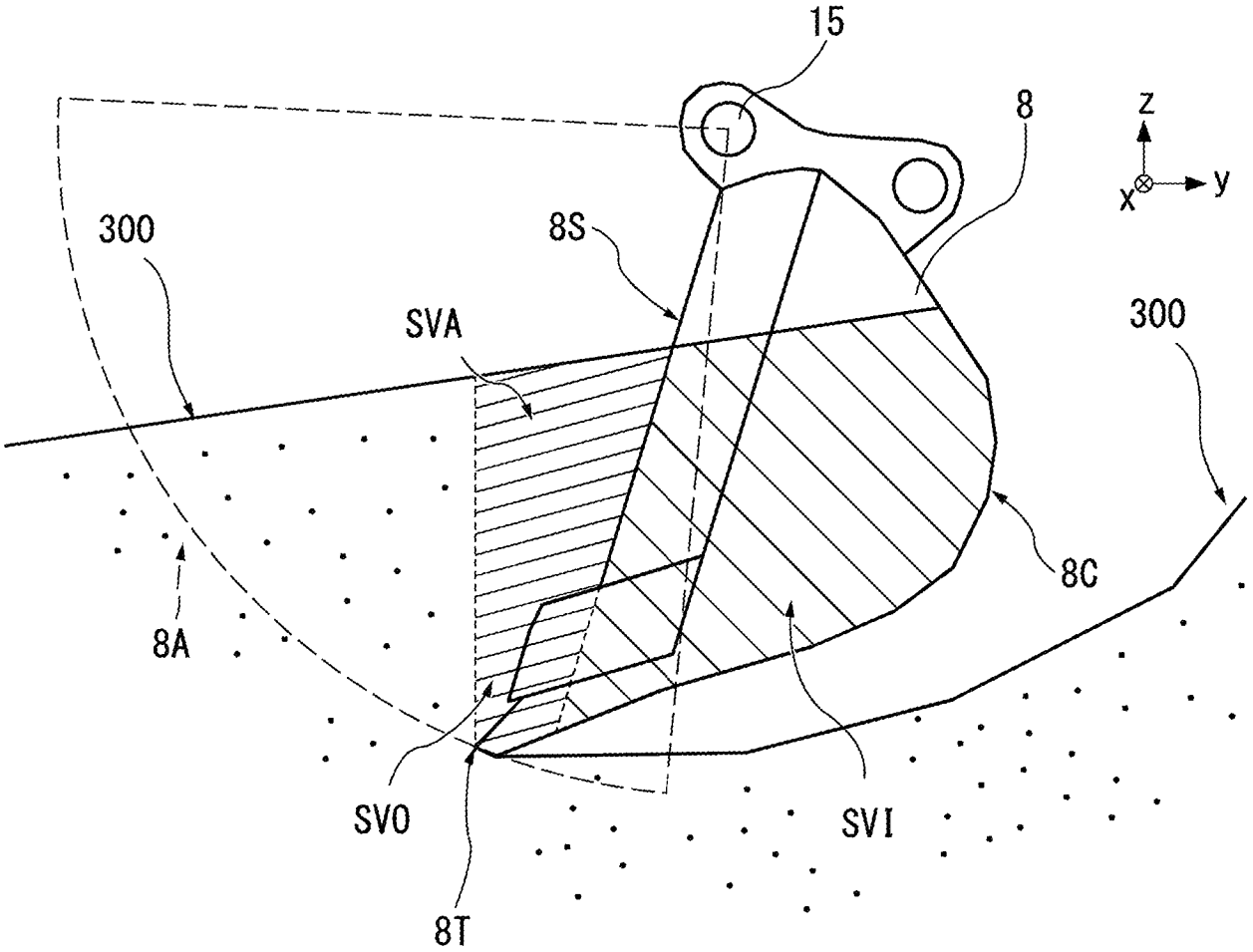
FIG. 7 is a side view schematically illustrating a bucket 8 shown in FIG. 1.

Further, in the present embodiment, the excavation earth amount estimation unit 122 estimates an inside-bucket earth amount SVI, which is an amount of earth stored in the bucket 8, and an outside-bucket earth amount SVO, which is an amount of earth predicted to be scooped by the bucket 8 in the future, as shown in FIG. 7, and calculates the excavation earth amount SVA by summing the inside-bucket earth amount SVI and the outside-bucket earth amount SVO. That is, the excavation earth amount estimation unit 122 calculates the excavation earth amount SVA using the following equation: excavation earth amount SVA=inside-bucket earth amount SVI+outside-bucket earth amount SVO. In addition, FIG. 7 is a side view (viewed from the x direction) schematically showing the bucket 8 during the excavation operation. FIG. 7 shows a state in which the excavation target object 300 (topography) being present short of the bucket 8 is raised due to the excavation operation of the bucket 8 from the topography before excavation.

Figure 9:
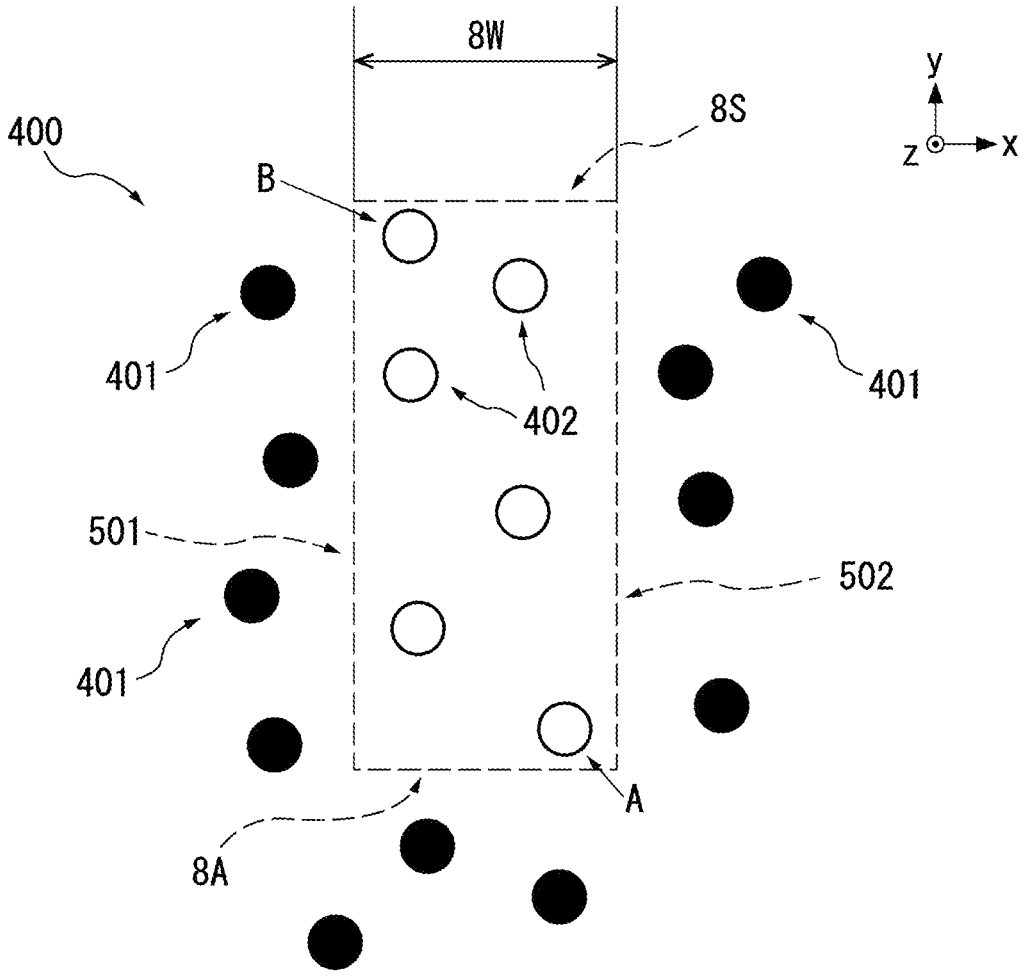
FIG. 9 is a schematic diagram illustrating an example of point cloud data 400 in the present embodiment.

As shown in FIGS. 7 and 9, the excavation earth amount estimation unit 122 extracts, from the target object position information (point cloud data 400), measurement points 402 located inside a circle 8A drawn by the bucket teeth edge 8T when the bucket 8 is rotated about the bucket pin 15 within a width 8W of the bucket 8, and estimates the excavation earth amount based on the position information of the extracted measurement points 402.

Figure 5:
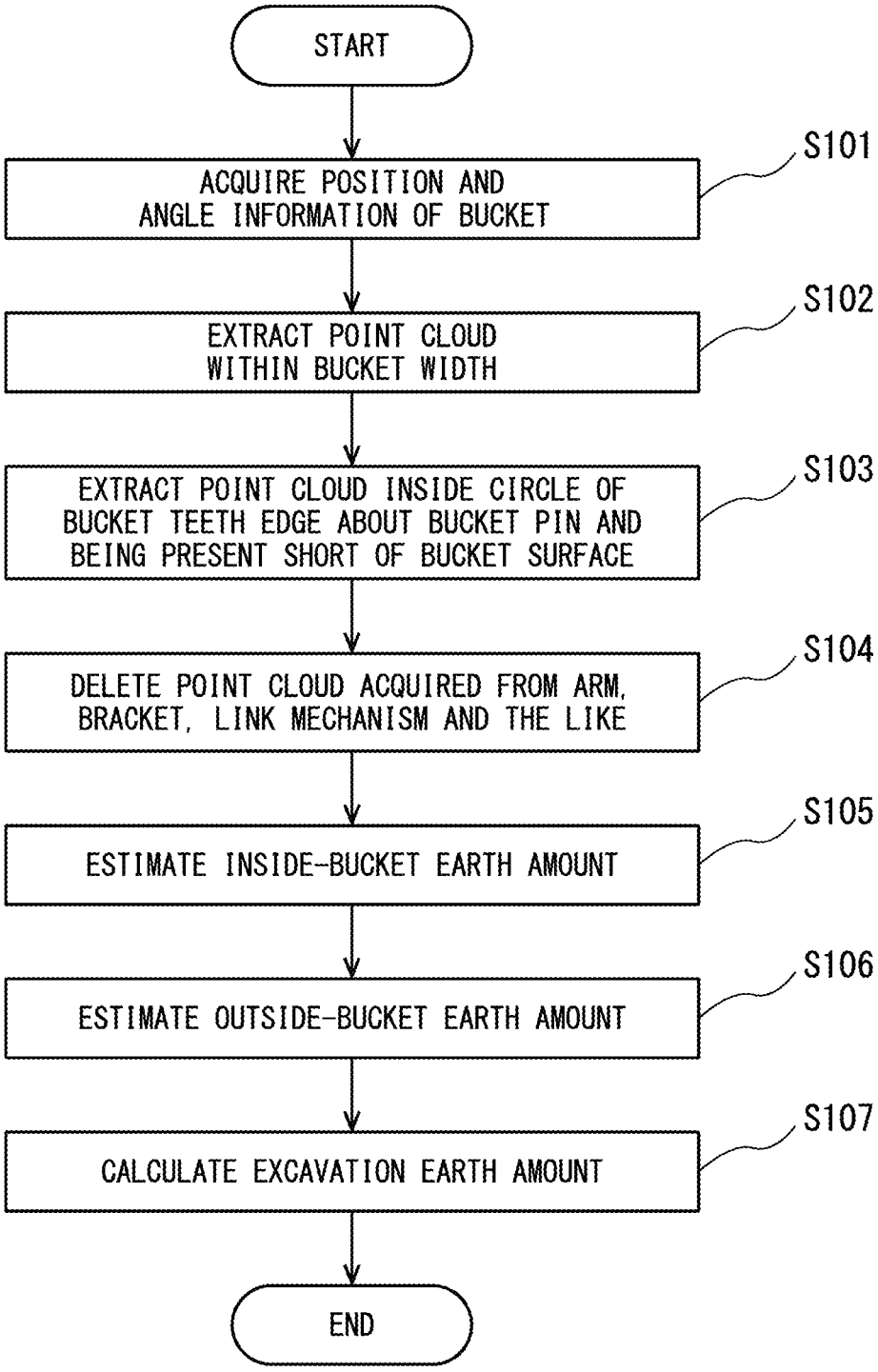
FIG. 5 is a flowchart illustrating an operation example of an excavation earth amount estimation unit 122 shown in FIG. 2.
Figure 8:
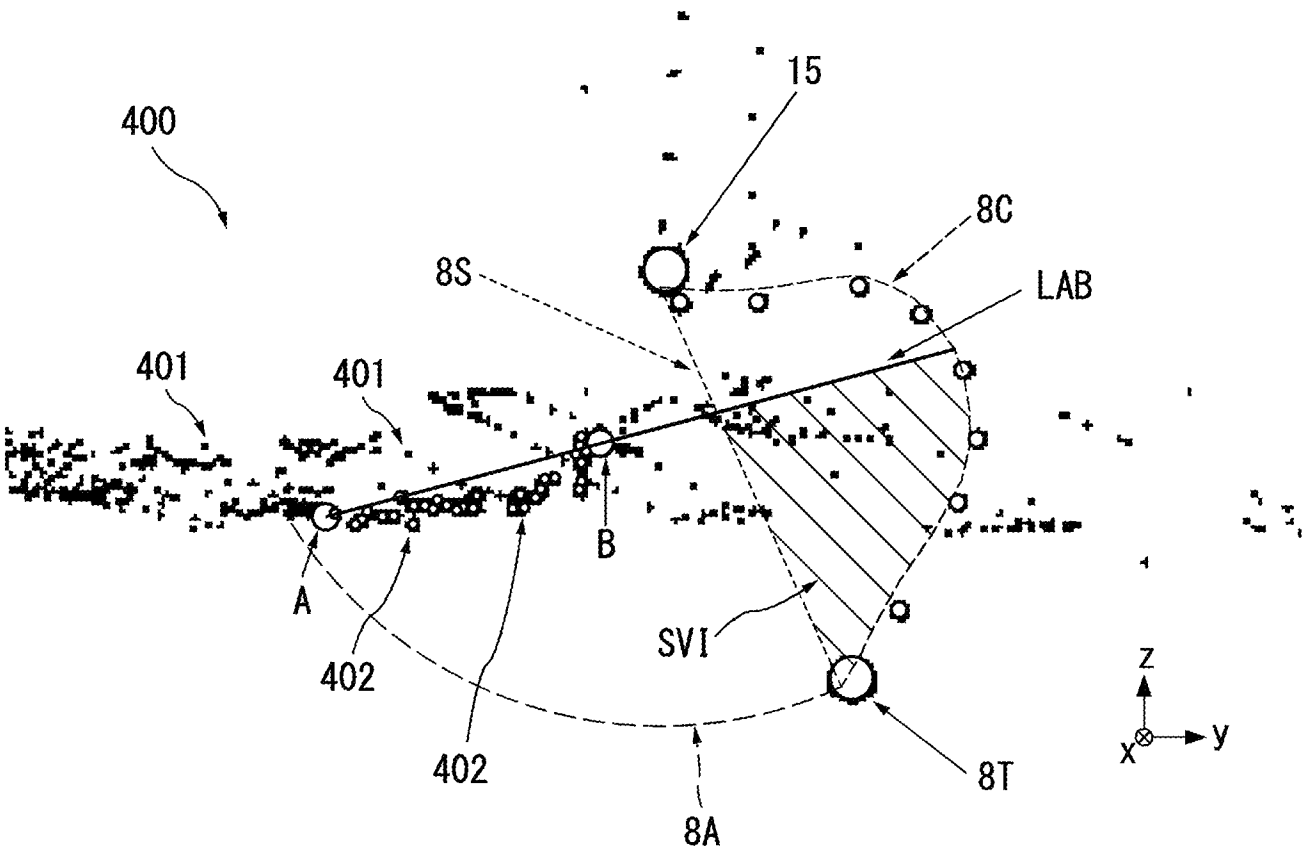
FIG. 8 is a side view schematically illustrating an example of the point cloud data 400 measured by the three-dimensional position information measurement unit 19 shown in FIG. 1.
Figure 10:
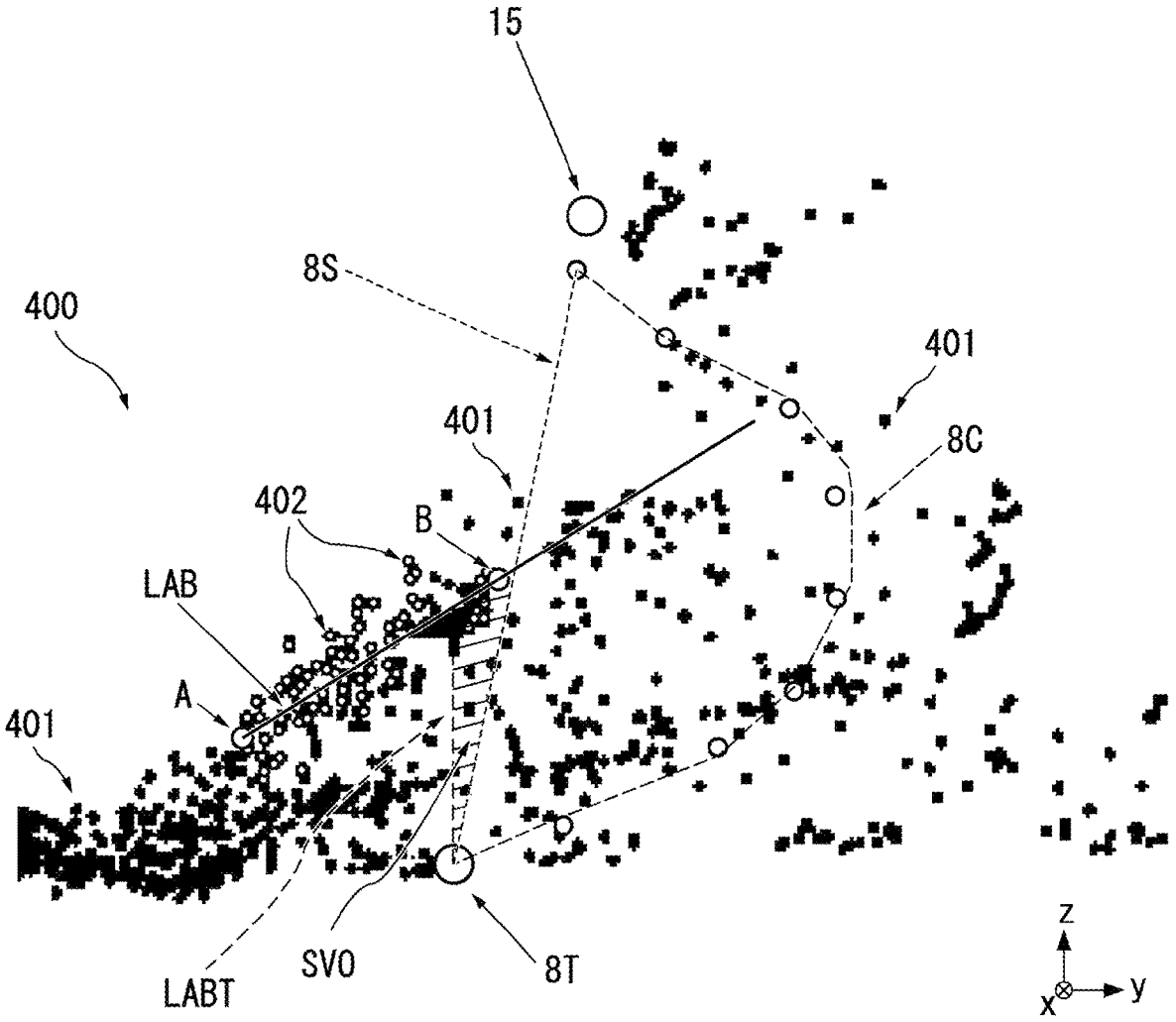
FIG. 10 is a side view schematically illustrating an example of the point cloud data 400 measured by the three-dimensional position information measurement unit 19 shown in FIG. 1.
Figure 11:
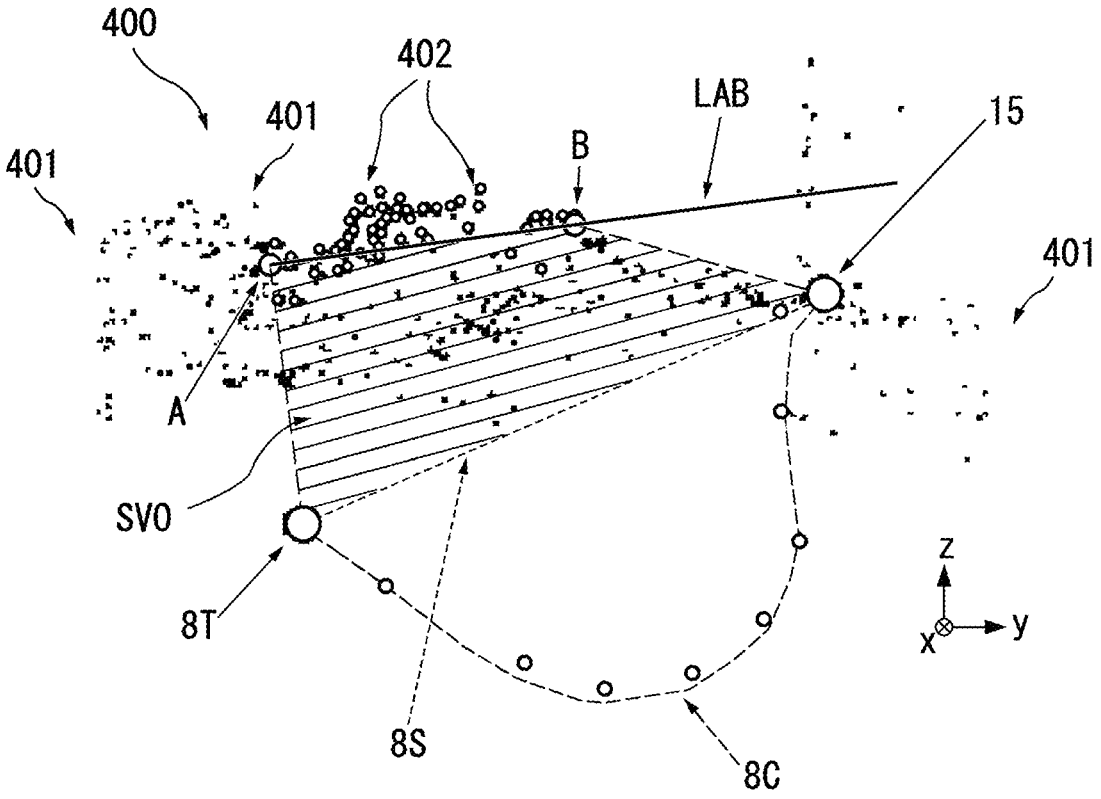
FIG. 11 is a side view schematically illustrating an example of point cloud data 400 measured by the three-dimensional position information measurement unit 19 shown in FIG. 1.

Here, an operation example when the excavation earth amount estimation unit 122 estimates the excavation earth amount will be described with reference to FIGS. 5 to 11. FIG. 5 is a flowchart showing an example of the operation for one cycle when the excavation earth amount estimation unit 122 repeatedly estimates the excavation earth amount at a predetermined cycle during the excavation operation. That is, the excavation earth amount estimation unit 122 repeatedly executes the processing shown in FIG. 5 at the predetermined cycle during the excavation operation. Further, FIGS. 8, 10, and 11 are side views (figures viewed from the x direction) schematically showing examples of the point cloud data 400 actually acquired during the excavation control. Further, FIG. 9 is a schematic diagram showing an example of the point cloud data 400.

As illustrated in FIG. 5, the excavation earth amount estimation unit 122 first acquires the position and angle information of the bucket 8 from the work equipment position and posture information acquired from the position and posture information acquisition unit 111 (step S101). Next, the excavation earth amount estimation unit 122 extracts a point cloud within the bucket width 8W (step S102) from the target object position information (point cloud 400), and further extracts a point cloud inside the circle 8A of the bucket teeth edge 8T about the bucket pin 15 and being present short of the bucket surface 8S (step S103). FIG. 9 illustrates an example of a point cloud (a plurality of measurement points 402) extracted from the point cloud 400 (the plurality of measurement points 401) at the step S102 and the step S103. Here, an inside of the bucket width 8W is a range interposed between two straight lines 501 and 502 obtained by extending the width 8W of the bucket 8 along the y direction of the local coordinate system as shown in FIG. 9. Further, the range inside the circle 8A of the bucket teeth edge 8T about the bucket pin 15 and being present short of the bucket surface 8S is within a range being an inside of the circle 8A shown in FIG. 7 and being not entered an inside of the bucket 8 from the bucket surface 8S.

Next, the excavation earth amount estimation unit 122 deletes a point cloud (part of the measurement points 402) acquired from the work equipment 2, such as the arm 7, the bracket, and a link mechanism, based on the work equipment position and posture information and a drawing information (dimension information) (step S104).

Next, the excavation earth amount estimation unit 122 estimates the inside-bucket earth amount SVI (step S105). In step S105, the excavation earth amount estimation unit 122 estimates the inside-bucket earth amount SVI, for example, as follows. That is, for example, the excavation earth amount estimation unit 122 first determines two measurement points which are the measurement point 402 (referred to as a representative point A) at a near side (the cab 4 side) and the measurement point 402 (referred to as a representative point B) on a far side as shown in FIG. 9 from the plurality of measurement points 402 extracted from the point cloud data 400 in the processing from step S102 to step S104. Next, as shown in FIG. 8, the excavation earth amount estimation unit 122 estimates, as the inside-bucket earth amount SVI, a lower (a lower side in the vertical direction) region (depth: bucket width 8W) surrounded by a straight line LAB connecting the representative point A and the representative point B, the bucket surface 8S, and a bucket contour 8C when viewed from the x direction.

Next, the excavation earth amount estimation unit 122 estimates the outside-bucket earth amount SVO (step S106). In step S106, for example, the excavation earth amount estimation unit 122 estimates the outside-bucket earth amount SVO as follows. That is, the excavation earth amount estimation unit 122 estimates the outside-bucket earth amount SVO by two types of calculation methods, for example, when viewed from the x direction, in a case where the straight line LAB connecting the representative point A and the representative point B determined in the step S105 and the bucket surface 8S intersect each other (FIG. 10) and in a case where they do not intersect each other (FIG. 11). First, in a case where the straight line LAB and the bucket surface 8S intersect each other, as shown in FIG. 10, when viewed from the x direction, the excavation earth amount estimation unit 122 estimates, as the outside-bucket earth amount SVO, a region (depth: bucket width 8W) surrounded by the straight line LAB connecting the representative point A and the representative point B and a straight line LABT extending vertically upward from the bucket surface 8S and the teeth edge 8T toward the straight line LAB. In a case where the straight line LAB and the bucket surface 8S do not intersect with each other, as shown in FIG. 11, when viewed from the x direction, the excavation earth amount estimation unit 122 estimates, as the outside-bucket earth amount SVO, a quadrangular region (depth: bucket width 8W) having the representative point A, the representative point B, the bucket pin 15, and the teeth edge 8T as vertexes.

Next, the excavation earth amount estimation unit 122 calculates the excavation earth amount SVA by summing the inside-bucket earth amount SVI estimated in step S105 and the outside-bucket earth amount SVO estimated in step S106 (step S107). By the above processing, the excavation earth amount estimation unit 122 sequentially estimates the excavation earth amount SVA acquired by the bucket 8 when the bucket 8 performs holding at that point in time during the excavation operation.

Further, the determination unit 123 determines as to whether the excavation earth amount estimated by the excavation earth amount estimation unit 122 has reached the target excavation earth amount, and outputs the determination result to the excavation control unit 112 as the holding determination information. The target excavation earth amount is a target value of the volume or weight of the excavation target object 300 acquired by the bucket 8 in one excavation operation. For example, the target excavation earth amount can be set by an operator or can be set automatically by the excavation control unit 112. Further, for example, when excavation and loading are repeated a plurality of times in the case of an operation of loading the excavation target object 300 onto a dump truck or the like, a loading earth amount can be controlled with high accuracy by adjusting, for example, the excavation earth amount of the last one time.

The display unit 124 displays a value of the excavation earth amount estimated by the excavation earth amount estimation unit 122 as a numerical value or a time-series graph on the display device 40 installed in the cab 4. In a case where the operator manually performs the excavation work, for example, the operator can perform the switching operation from the excavation to the holding with reference to the estimation result of the excavation earth amount displayed on the display device 40. In this case, the excavation information processing device 120 including the three-dimensional position information acquisition unit (acquisition unit) 121, the excavation earth amount estimation unit 122, and the display unit 124 has an aspect as an excavation support device.

Figure 4:
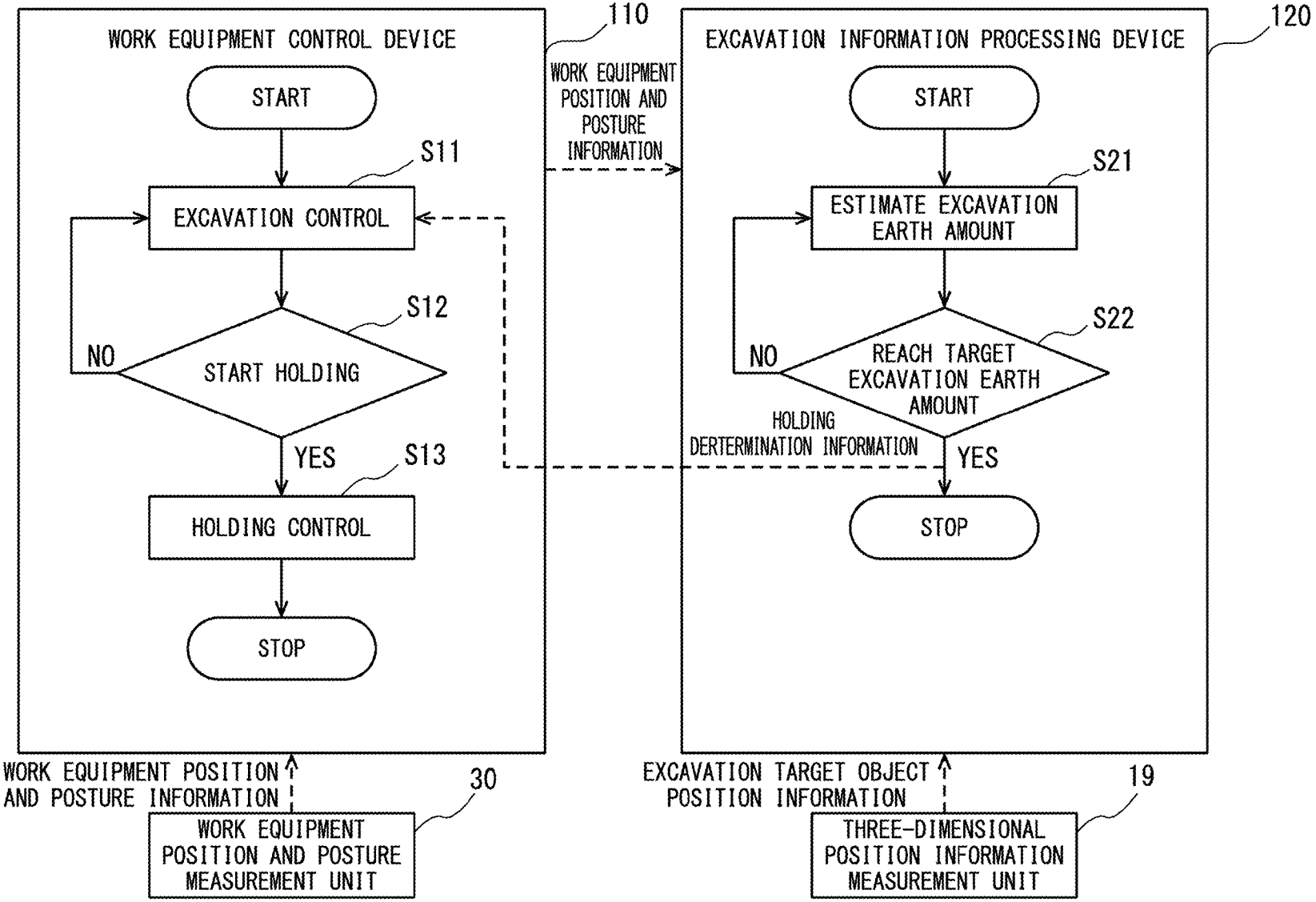
FIG. 4 is a system flow diagram illustrating an operation example of the work equipment control device 110 and the excavation information processing device 120 shown in FIG. 2.

Next, an operation example of the work equipment control device 110 and the excavation information processing device 120 illustrated in FIG. 2 will be described with reference to FIG. 4. FIG. 4 is a system flow diagram illustrating an operation example of the work equipment control device 110 and the excavation information processing device 120 illustrated in FIG. 2 in a case where the excavation control and the holding control are automatically performed once. The operation shown in FIG. 4 is started, for example, when the target excavation earth amount is set in advance and the operator gives an instruction to start the excavation control in a state where the bucket 8 has moved to the excavation start position. When the operation shown in FIG. 4 is started, in the work equipment control device 110, the excavation control unit 112 performs the excavation control (step S11), and repeatedly determines as to whether to switch to the holding control based on the holding determination information in a predetermined cycle (step S12). In the excavation information processing device 120, when the operation shown in FIG. 4 is started, repeatedly at a predetermined cycle, the excavation earth amount estimation unit 122 estimates the excavation earth amount (step S21) and the determination unit 123 determines as to whether the excavation earth amount estimated by the excavation earth amount estimation unit 122 has reached the target excavation earth amount (step S22).

In a case where the excavation earth amount has reached the target excavation earth amount, the determination unit 123 outputs holding determination information indicating that the excavation earth amount has reached the target excavation earth amount (in the case of "YES" in step S22). When the excavation control unit 112 receives the holding determination information indicating that the excavation earth amount has reached the target excavation earth amount, the excavation control unit 112 determines to perform switching to the holding control (in the case of "YES" in step S12), and the holding control unit 113 performs the holding control (step S13).

Figure 12:
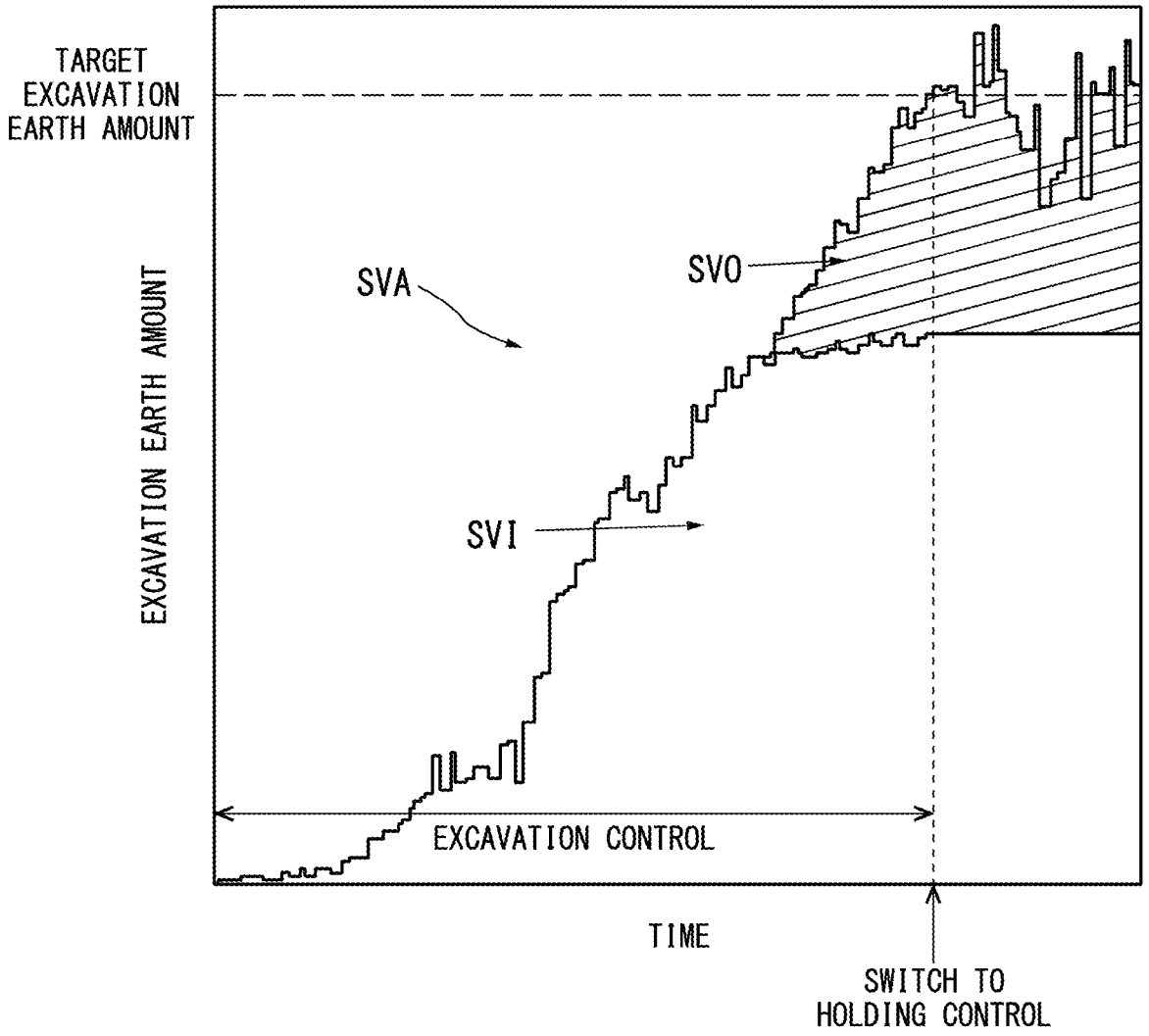
FIG. 12 is a schematic diagram illustrating an example of a temporal transition of excavation earth amount in the present embodiment.

FIG. 12 is a schematic diagram showing an example of a temporal transition of the excavation earth amount in the operation shown in FIG. 4. A horizontal axis represents time, and a vertical axis represents the excavation earth amount. When excavation is started, first, the inside-bucket earth amount SVI gradually increases, and the outside-bucket earth amount SVO starts to increase from an amount in which the inside-bucket earth amount SVI has increased to a predetermined extent. Then, when the excavation earth amount SVA has reached the target excavation earth amount, switching to the holding control is performed.

As described above, according to the present embodiment, since the excavation earth amount can be sequentially estimated during the excavation work, the excavation earth amount can be easily adjusted to a freely-selected value.

Although the embodiments of the present disclosure have been described with reference to the drawings, specific configurations are not limited to the above-described embodiments, and design changes and the like within a range not departing from the gist of the present disclosure are also included.

For example, the excavator 1 may automatically control the vehicle main body 1B and the work equipment 2 in an unmanned manner, may remotely control them, or may control them by a combination of automatic control, remote control, and manual control by an operator. Further, in the above-described embodiment, the case where the coordinate information in the local coordinate system is mainly used has been described as an example, but the coordinate information converted into the global coordinate system may be used.

In addition, part or all of the program executed by the computer in the above-described embodiment can be distributed via a computer-readable recording medium or a communication line.

According to each aspect of the present disclosure, the excavation earth amount can be easily adjusted to a freely-selected value.

The invention claimed is:

1. An excavation information processing device, comprising:

a processor configured to acquire target object position information indicating an excavation target object by position information of a plurality of points;

processor configured to sequentially estimate and output an excavation earth amount acquired by a bucket when the bucket performs holding at that point in time, based on a bucket position and posture information indicating a position and a posture of the bucket and the target object position information;

and a processor configured to output a determination result as to whether the excavation earth amount has reached a target excavation earth amount, the processor further configured to estimate an inside-bucket earth amount that is an earth amount stored in the bucket, estimate an outside-bucket earth amount that is an earth amount predicted to be scooped by the bucket in the future, the outside-bucket earth amount being based on a region of the excavation target object extending outwardly from a bucket surface, calculate the excavation earth amount by summing the inside-bucket earth amount and the outside-bucket earth amount;

and an electronic controller configured to switch from an excavation control to a holding control upon determining that the excavation earth amount has reached the target excavation earth amount.

2. The excavation information processing device according to claim 1, wherein the processor is further configured to extract extracts, from the target object position information, the points located inside a circle drawn by a bucket teeth edge when the bucket is rotated about a bucket pin within a width of the bucket, and estimate estimates the excavation earth amount based on position information of the extracted points.

3. A work machine comprising: the excavation information processing device according to claim 1;

and the bucket.

4. An excavation support device, comprising:

a processor configured to acquire target object position information indicating an excavation target object by position information of a plurality of points;

an processor configured to sequentially estimate an excavation earth amount acquired by a bucket when the bucket performs holding at that point in time, based on a bucket position and posture information indicating a position and a posture of the bucket and the target object position information;

and a display unit configured to display the excavation earth amount;

and a processor configured to output a determination result as to whether the excavation earth amount has reached a target excavation earth amount, the processor further configured to estimate an inside-bucket earth amount that is an earth amount stored in the bucket, estimate an outside-bucket earth amount that is an earth amount predicted to be scooped by the bucket in the future, the outside-bucket earth amount being based on a region of the excavation target object extending outwardly from a bucket surface, calculate the excavation earth amount by summing the inside-bucket earth amount and the outside-bucket earth amount;

and an electronic controller configured to switch from an excavation control to a holding control upon determining that the excavation earth amount has reached the target excavation earth amount.

5. An excavation information processing method comprising the steps of:

acquiring target object position information indicating an excavation target object by position information of a plurality of points;

and sequentially estimating and outputting an excavation earth amount acquired by the bucket when a bucket performs holding at that point in time, based on bucket position and posture information indicating a position and a posture of the bucket and the target object position information;

estimating an inside-bucket earth amount that is an earth amount stored in the bucket, estimating an outside-bucket earth amount that is an earth amount predicted to be scooped by the bucket in the future, the outside-bucket earth amount being based on a region of the excavation target object extending outwardly from a bucket surface, calculating the excavation earth amount by summing the inside-bucket earth amount and the outside-bucket earth amount;

determining whether the excavation earth amount has reached a target excavation earth amount;

and switching from an excavation control to a holding control upon determining that the excavation earth amount has reached the target excavation earth amount.

6. A work machine comprising: the excavation information processing device according to claim 4;

and the bucket.

7. A work machine comprising: the excavation information processing device according to claim 1;

the bucket;

and a work equipment control device configured to move the bucket to a predetermined height when the excavation earth amount has reached the target excavation earth amount.

* * * * *